US007434661B1

(12) United States Patent
Storey

(10) Patent No.: US 7,434,661 B1
(45) Date of Patent: Oct. 14, 2008

(54) PORTABLE LADDER

(76) Inventor: Robert D. Storey, 17242 Blue Spruce La., Yorba Linda, CA (US) 92886

( * ) Notice: Subject to any disclaimer, the term of this patent is extended or adjusted under 35 U.S.C. 154(b) by 124 days.

(21) Appl. No.: 11/147,722

(22) Filed: Jun. 7, 2005

(51) Int. Cl.
*E06C 7/00* (2006.01)

(52) U.S. Cl. ..... 182/100; 182/206

(58) Field of Classification Search ..... 182/206, 182/93, 100, 189, 194
See application file for complete search history.

(56) References Cited

U.S. PATENT DOCUMENTS

| | | | | | |
|---|---|---|---|---|---|
| 104,569 | A * | 6/1870 | Floyd | 182/161 |
| 200,767 | A * | 2/1878 | Sanderson | 108/106 |
| 259,537 | A * | 6/1882 | Hawkins | 182/82 |
| 455,639 | A * | 7/1891 | Roden | |
| 508,816 | A * | 11/1893 | Craig | 182/156 |
| 607,323 | A * | 7/1898 | Anderson | 182/123 |
| 751,359 | A * | 2/1904 | Stronach et al. | 248/214 |
| 1,669,329 | A * | 5/1928 | Elder | 182/150 |
| 1,964,124 | A * | 6/1934 | Keller | 108/96 |
| 2,333,849 | A * | 11/1943 | Driscoll | 182/21 |
| 2,876,047 | A * | 3/1959 | La Plante | 182/206 |
| 3,134,567 | A * | 5/1964 | Shoemaker | 248/243 |
| 4,904,105 | A * | 2/1990 | Myers | 403/24 |
| 4,971,169 | A * | 11/1990 | Fruth | 182/119 |
| D359,470 | S * | 6/1995 | Allyn | D12/317 |
| 2005/0173191 | A1 * | 8/2005 | Linzmayer | 182/127 |

* cited by examiner

*Primary Examiner*—Alvin C Chin-Shue
(74) *Attorney, Agent, or Firm*—Berenato, White & Stavish

(57) ABSTRACT

The present invention may be used for climbing over a fence or a vertical barrier. A body may have a plurality of steps attached orthogonal to the body. The body may have a width and length to fit between two vertical bar fence elements and to position the steps generally perpendicular to a plane of a fence. A top hook may be attached to a top end of the body. A horizontal bar may be attached at a bottom end of the body generally orthogonal to the steps. A rotatable member may be rotatably attached to the body and may be spaced apart from the body by a pedestal.

7 Claims, 1 Drawing Sheet

PORTABLE LADDER

BACKGROUND OF THE INVENTION

This invention relates to apparatus for climbing over a fence or vertical barrier. The new portable ladder may have a body that may be hung vertically over an upper horizontal rail of a vertical bar fence and fixed in place between two vertical bar fence elements to allow a person to climb over the fence.

Use of a ladder to climb over a fence or a vertical barrier may be known. These ladders may be generally vertical ladders or step ladders. Also, rope or suspension ladders may be used to climb walls from windows or to climb over objects such as fences. However, these devices may not be compact or rigid for ease of transport and stability in use for climbing a fence.

SUMMARY OF THE INVENTION

The present invention is directed to apparatus for climbing over a fence or a vertical barrier. A body may have a plurality of steps attached orthogonal to the body. The body may have a width and length to fit between two vertical bar fence elements and to position the steps generally perpendicular to a plane of a fence. A top hook may be attached to a top end of the body. A horizontal bar may be attached at a bottom end of the body generally orthogonal to the steps. A rotatable member may be rotatably attached to the body and may be spaced apart from the body by a pedestal.

These and other features, aspects and advantages of the present invention will become better understood with reference to the following drawings, description and claims.

DETAILED DESCRIPTION

The following detailed description represents the best currently contemplated modes for carrying out the invention. The description is not to be taken in a limiting sense, but is made merely for the purpose of illustrating the general principles of the invention.

Figure 1:
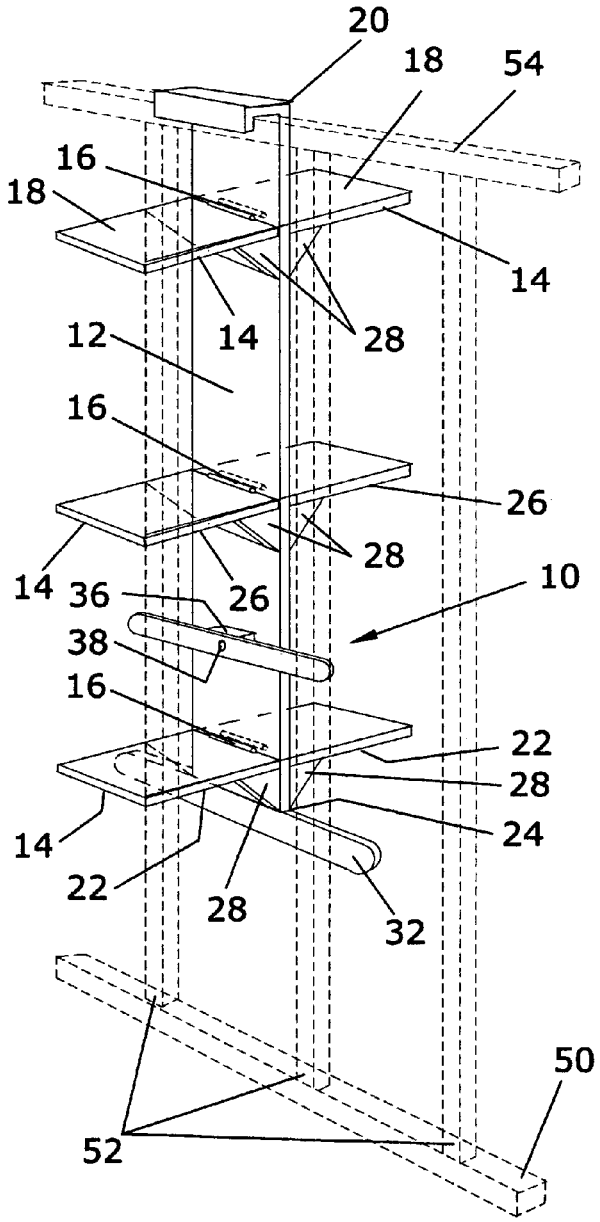
FIG. 1 illustrates a perspective elevation view of the portable ladder according to an embodiment of the invention.
Figure 2:
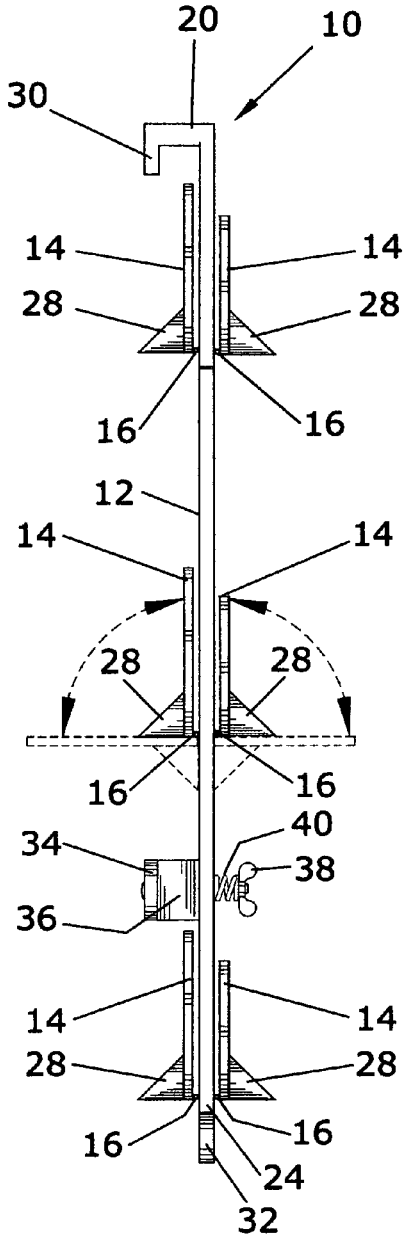
FIG. 2 illustrates a side elevation view of the portable ladder according to an embodiment of the invention.

Referring to FIGS. 1 and 2, a portable ladder 10 may have a body 12 that may be an elongated, flat bar that may be made of metal, wood, plastic or like rigid material. The body 12 may have a width to fit between vertical bar fence elements 52 having a variety of separation distances. For example, the body 12 may be approximately 4 inches wide. Depending on the height of fences 50 encountered the length of the body may be for example approximately 50 inches.

There may be multiple steps 14 that may extend perpendicular or orthogonal to the body 12 for use of a person to climb the portable ladder 10. The steps 14 may be attached to the body 12 by a hinge 16 to allow rotation of the steps 14 against and parallel to the body 12. This may provide for a compact ladder for transport and storage. For example, if the portable ladder may be used in police work, it may be transported in the trunk of a car.

The Figures illustrate a portable ladder 10 with three steps 14 on each side of the body 12. This may be approximate for a variety of vertical bar fences of generally standard height. For an approximately 53 inch long body 12 the top steps 18 may be approximately 14 inches from the top end 20. The bottom steps 22 may be adjacent the bottom end 24. The intermediate steps 26 may be approximately centered between the top steps 18 and bottom steps 22. The steps 14 may have brackets 28 for structural support of the load placed on the steps by a user in climbing. The opposed steps 14 at each location, such as, the top steps 18 may be of different length to adjust for the width of a fence 50. For example, the step 14 protruding through the fence 50 may be approximately one inch longer than the opposed step 14 that does not protrude through the fence 50 as best viewed in FIG. 2.

There may be a top hook 30 that may be in the form of an inverted "U" channel that may be attached at the top end 20 that may be placed on the upper horizontal rail 54 of the fence 50. There may be a horizontal bar 32 attached to the bottom end 24 wherein the bar 32 may be longer than the separation distance between the vertical bar fence elements 52 such that when the portable ladder 10 is hocked on a fence 50 the body will not rotate through the vertical bar fence elements 52 or the vertical plane of the fence. There may be a rotatable member 34 or bar that may be approximately the same length as the horizontal bar 32. The rotatable member 34 may be spaced apart from the body 12 by a pedestal 36 attached to the body 12 between the intermediate steps 26 and bottom steps 22. There may be a bolt and nut 38 for rotatable attachment of the rotatable member 34. There may be a spring 40 disposed on the bolt between the body 12 and the nut 38 to apply pressure to retain the rotatable member 34 at a set orientation.

In use the steps 14 may be extended perpendicular to the body 12 as best viewed in FIG. 1. The top hook 30 may be placed on upper horizontal rail 54 to position the body 12 between two vertical bar fence elements 52. The horizontal bar 32 may then abut the two vertical bar fence elements 52. The rotatable member 34 may then be rotated from a generally vertical orientation to a horizontal orientation. This may prevent movement of the portable ladder 10 from the vertical plane of the fence 50 as a user climbs up either side of the portable ladder 10. When the climb is complete the rotatable member 34 may be rotated to a general vertical orientation and the portable ladder 10 may be removed.

While the invention has been particularly shown and described with respect to the illustrated embodiments thereof, it will be understood by those skilled in the art that the foregoing and other changes in form and details may be made therein without departing from the spirit and scope of the invention.

I claim:

1. An apparatus for climbing over a vertical barrier comprising:

a body having a plurality of steps attached orthogonal to said body; said plurality of steps comprise a first set of steps attached on a first side of said body and a second set of steps attached on a second side of said body;

said body having a width and a length to be disposable between two vertical bar fence elements and for positioning said steps generally perpendicular to a plane of a vertical barrier defined in part by said vertical bar fence elements;

a top hook attached to a top end of said body, said top hook defining a u-shaped member that extends parallel to at least one of said plurality of steps;

a horizontal bar attached at a bottom end of said body generally orthogonal to said steps and having a length for abutting said two vertical bar fence elements;

a rotatable member disposed on one side of said body and rotatably attached to said body and spaced apart from said body by a pedestal wherein said rotatable member rotatable between a first position allowing insertion through said two vertical bar fence elements and a second position allowing abutment of said rotatable member against said two vertical bar fence elements;

a bolt attaching said rotatable member to said body, said bolt passing through said body; and a biasing member on said bolt on an opposite side of said body opposite said one side to apply pressure to retain the rotatable member at a set orientation; said plurality of steps are attached by hinge and said plurality of steps have a step width that is equal to or less than said width of said body, said body being formed as a planar solid member.

2. The apparatus as in claim 1 wherein said plurality of steps have a bracket attached between said plurality of steps and said body.

3. The apparatus as in claim 1 wherein said rotatable member is attached by a bolt and a nut.

4. The apparatus as in claim 3 wherein said biasing member is disposed on said bolt intermediate said body and said nut.

5. The apparatus as in claim 1 wherein:

said body is generally a flat bar shape having a width of approximately 4 inches and a length of approximately 53 inches;

a first one of said plurality of steps is a top step disposed approximately 14 inches from said top end;

a second one of said plurality of steps is a bottom step disposed approximately adjacent said bottom end a third one of said plurality of steps is an intermediate step disposed approximately equal distance from said top step and said bottom steps; and said rotatable member is disposed between said bottom step and said intermediate step.

6. The apparatus as in claim 5 where each of said top step, said bottom step and said intermediate step is a pair of steps attached on opposite sides of said body in opposed position.

7. The apparatus as in claim 6 wherein each of said pair of steps have a first opposed step longer in length than a second opposed step.

* * * * *